United States Patent [19]

Jones

[11] Patent Number: 4,559,246

[45] Date of Patent: Dec. 17, 1985

[54] METHOD OF INCREASING THE WETTABILITY OF A SURFACE BY A MOLTEN METAL

[75] Inventor: William R. Jones, Derby, England

[73] Assignee: Rolls-Royce Limited, London, England

[21] Appl. No.: 703,532

[22] Filed: Feb. 20, 1985

[30] Foreign Application Priority Data

Apr. 5, 1984 [GB] United Kingdom ..... 8408754

[51] Int. Cl.[4] ..... B05D 3/00

[52] U.S. Cl. ..... 427/299; 164/101; 228/263.17; 427/431; 427/432

[58] Field of Search ..... 427/299, 383.3, 431, 427/432; 164/101, 102; 228/263.17, 203

[56] References Cited

U.S. PATENT DOCUMENTS 3,287,158 11/1966 Whitfield ..... 427/431

*Primary Examiner*—Sam Silverberg

*Attorney, Agent, or Firm*—Cushman, Darby & Cushman

[57] ABSTRACT

A method of treating filaments in order to increase their wettability by molten magnesium or an alloy thereof. The filaments are treated by coating them with particulate molybdenum trioxide, chromic oxide, ferric oxide or nickel oxide and subsequently infiltrating them with molten magnesium or an alloy thereof.

13 Claims, No Drawings

METHOD OF INCREASING THE WETTABILITY OF A SURFACE BY A MOLTEN METAL

This invention relates to a method of increasing the wettability of a surface by a molten metal and in particular to a method of increasing the wettability of a surface by molten magnesium or alloys thereof.

It has been proposed to manufacture composite materials which comprise reinforcing filaments enclosed in a metal matrix by infiltrating a suitable assembly of filaments, which may for instance be woven so as to define a cloth, with a molten metal. The filaments may be infiltrated by capillary action in which they are partially or wholly immersed in the molten metal. Alternatively vacuum infiltration may be used in which the filaments are enclosed in an evacuated chamber whereupon the molten metal is admitted into the chamber. There is great difficulty with all of these techniques however in achieving complete wetting of the filaments by the molten metal. Incomplete wetting of the filaments results in the creation of voids within the resultant composite material which in turn has a detrimental effect upon the strength of the composite material. Additionally, infiltration can take a long time, thereby possibly causing a problem of filament degradation by the molten metal.

Even if acceptable wetting is achieved there are additional difficulties if it is desired to weld or braze examples of the composite material to each other or to other components. The localised melting of the matrix metal during the welding or brazing operation causes a corresponding localised de-wetting of the reinforcing filaments. This leads in turn to porosity in the region of the weld or braze.

The problem of surface wetting by a molten metal is particularly troublesome when the metal is magnesium or an alloy thereof. If for instance woven filaments of a reinforcing material such as fibrous alumina are dipped in molten magnesium, the amount of metal which infiltrates and is retained by the filaments is minimal. There are further problems of surface wetting if it is desired to cast magnesium objects which have thin walls. Thus it is difficult to achieve wetting of the internal surfaces of the mold by the molten magnesium, thereby frequently resulting in defective castings.

It is an object of the present invention to provide a method of treating surfaces which are to be wetted by molten magnesium so as to increase their wettability.

According to the present invention, a method of treating a surface so as to increase its wettability by molten magnesium or an alloy thereof comprises providing said surface with a coating of particulate molybdenum trioxide, chromic oxide, ferric oxide or nickel oxide and subsequently bringing said coated surface and said molten magnesium or alloy thereof into intimate contact under conditions which inhibit the oxidation of said magnesium or alloy thereof.

The surface to be treated may be provided by filaments which are to be infiltrated by the molten magnesium or alloy thereof so as to produce a composite material which comprises a matrix of the magnesium or alloy thereof which is reinforced by the filaments. The filaments may be in the form of tows which are either individually grouped or alternatively woven together in the form of a cloth.

The filaments must be capable of withstanding the temperature of the molten magnesium or alloy thereof without melting or degrading to any substantial extent. Thus mention may be made of filaments which are formed from alumina or silicon carbide. Likewise if the surface to be treated is not in the form of filaments, it must be similarly capable of withstanding the temperature of the molten magnesium or alloy thereof. Thus the surface may be constituted by a sheet of a metal having a higher melting point then that of magnesium or alloys thereof.

Although we have found that the oxides of chromium iron and nickel are effective in increasing the wettability of a surface by molten magnesium on an alloy thereof, the best results have been achieved by the use of molybdenum trioxide. The oxide may be applied to the surface to be treated in the form of the particulate oxide by brushing or any other convenient mechanical method. Alternatively it may be suspended in a suitable liquid vehicle such as isopropyl alcohol, and sprayed on to the surface whereupon the liquid vehicle is evaporated off. A still further method of application is to suspend the particulate oxide in a resin binder, (which may also be used for filament sizing purposes). The binder/oxide particle suspension is applied to the surface by any convenient means, and the resin binder subsequently burnt off.

It may be desirable in certain circumstances to apply a compound of chromium nickel, iron or molybdenum to the surface to be treated which is subsequently oxidised to produce the desired oxide thereof. Thus we have found it particularly effective to apply molybdenum disulphide to the surface to be treated and then heat the surface in air at a temperature in excess of 450° in order to oxidise the molybdenum disulphide to molybdenum trioxide. If it is desired to apply a solution to the surface to be treated, a soluble salt, such as ammonium molybdate, may be utilised. After application to the surface to be treated, the salt is oxidised in air as described above to produce a substantial amount of the trioxide.

The molten magnesium or alloy thereof may be applied to the treated surface by resting a block of the metal on the treated surface in a furnace having an inert atmosphere and then raising the furnace temperature to the melting point of the metal. The molten metal then spreads over the treated surface in the case of planar surfaces and, in the case of tows of filaments, infiltrates those filaments. If problems of inert gas entrapment within the resultant applied alloy occur, it may be desirable to carry out the magnesium or alloy thereoff application under partial or complete vacuum.

An alternative method of application of the magnesium or alloy thereof is to immerse the treated surface in the molten metal. In such circumstances it may not be necessary to carry out the application in a inert atmosphere. Thus for example, the surface molten magnesium or alloy thereof could be covered by a material such as sulphur, which prevents its oxidation.

If the treated surface is in the form of filament tows, only a portion thereof need be immersed in the molten metal. Infiltration of the remainder of the tows is achieved by the capillary action of the molten metal between the individual filaments. Similarly if it is desired to wet planar surfaces which are closely spaced apart, capillary pumping may be utilised to fill the gap between the surfaces with the molten metal.

The method of the present invention is also particularly useful in the manufacture of composite materials which comprise particulate material or short lengths of filaments in a matrix of magnesium or alloy thereof. One convenient method of achieving this is to add a small amount of particulate molybdenum trioxide, chromic oxide, ferric oxide or nickel oxide to the particulate or filamentary material and then bring molten magensium or an alloy thereof into intimate contact therewith.

The method of the present invention is also useful when it is desired to join composite materials comprising filaments enclosed in a magnesium or magnesium alloy matrix by brazing or welding. If the surfaces in the region of the weld or braze are treated in accordance with the method of the present invention in order to improve their wettability, there will be less likelihood of the resultant braze or weld being unacceptable as a result of de-wetting.

The following examples will serve to further illustrate the present invention.

EXAMPLE 1

A tow of 20 μm diameter FP alumina filaments (αalumina obtained from Dupont Limited) was sprayed with a suspension of molybdenum disulphide in iso-propyl alcohol and laid on a stainless steel sheet, a similar tow but which had not been so sprayed was also laid on the stainless steel sheet in spaced apart relation with the first tow. The sheet was then treated at above 450° C. in air to evaporate the alcohol and oxidise the molybdenum disulphide to molybdenum trioxide. A small block of a magnesium alloy containing the following constituents by weight:

| | |
|---|---|
| Silver | 3% |
| Copper | 0.03% |
| Nickel | 0.005% |
| Zinc | 0.2% |
| Rare Earths | 1.5% |
| Thorium | 1.6% |
| Zirconium | 1% |
| Balance Magnesium plus impurities. | |

was placed on top of a portion of each the filament tows. The sheet was then placed in a furnace containing an argon atmosphere and the temperature of the furnace was raised to 650° C. to melt the magnesium alloy. The furnace was then allowed to cool whereupon the sheet was removed and examined. It was found that the molten magnesium alloy had failed to infiltrate the two which had not been treated with the molybdenum trioxide. However the treated tow had been completely infiltrated by the molten magnesium alloy. Moreover the infiltrated tow was firmly bonded to the sheet. Thus it was clear that the treatment of the tow with molybdenum trioxide had considerably increased its wettability by the molten magnesium alloy which had led in turn to its high level of infiltration by the molten magnesium alloy. Moreover, the molybdenum trioxide on the tow had also affected the stainless steel sheet in the vicinity of the tow to the extent that it too had been effectively wetted by the magnesium alloy.

EXAMPLE 2

Example 1 was repeated with the exception that the stainless steel sheet was curved in one plane and the filament tows anchored adjacent opposite edges thereof so that the majority of the tows were spaced apart from the sheet surface. Additionally the magnesium alloy blocks were placed on those portions of the tows which were anchored to the sheets.

After the furnace temperature had been raised to melt the magnesium alloy and subsequently allowed to cool, the tows were examined. As in the case of the previous example, the molten magnesium alloy had failed to infiltrate the tow which had not been treated with the molybdenum trioxide. However the treated tow had been completely infiltrated by the alloy, thereby demonstrating that the infiltration of the tow was independent of whether the tow was supported by a surface.

EXAMPLE 3

Example 1 was repeated with the exception that a suspension of molybdenum trioxide in iso-propyl alcohol was used in place of the molybdenum disulphide/alcohol suspension. The temperature of the treated tows was accordingly only raised to a sufficient level to evaporate off the alcohol. After exposure to the molten magnesium alloy, the untreated tow was found not to have been infiltrated by the alloy whereas the treated tow had been completely infiltrated.

EXAMPLE 4

Example 3 was repeated with the exception that chromic oxide was used in place of the molybdenum trioxide. The tow treated with the chromic oxide was found to have been infiltrated by the molten magnesium alloy but not as effectively as had been the case with the tow treated with the molybdenum trioxide. The remaining untreated tow was found to have not been infiltrated by the alloy.

EXAMPLE 5

Example 3 was repeated with the exception that ferric oxide was used in place of the molybdenum trioxide. The tow treated with the ferric oxide was found to have been infiltrated by the molten magnesium alloy but not as effectively as had been the case with the tow treated with the molybdenum trioxide. The remaining tow was found not to have been infiltrated by the alloy.

EXAMPLE 6

Example 3 was repeated with the exception that nickel oxide was used in place of the molybdenum trioxide. The tow treated with the nickel oxide was found to have been infiltrated by the molten magnesium alloy but not as effectively as had been the case with the tows treated with molybdenum trioxide, chromic oxide and ferric oxide. The remaining tow had not been infiltrated by the alloy.

EXAMPLE 7

Example 1 was repeated with the exception that the tows consisted of 10 μm diameter filaments of β alumina (obtained from Sumitomo Chemicals). The treated tow was found to have been completely infiltrated by the molten magnesium alloy whereas the untreated tow was found not to have been infiltrated.

EXAMPLE 8

Example 1 was repeated with the exception that the tows consisted of 14 μm diameter filaments of Nicalon silicon carbide (obtained Nippon Carbon Co.). The treated tow was found to have been completely infiltrated by the molten magnesium whereas the untreated tow was found not to have been infiltrated.

EXAMPLE 9

Example 1 was repeated with the exception that the tows consisted of 1.4 mm diameter filaments of silicon carbide (obtained from Zigma Composites). The treated tow was found to have been completely infiltrated by the molten magnesium alloy whereas the untreated tow was found not to have been infiltrated.

EXAMPLE 10

A pile of 220 mesh silicon carbide grit was placed on a stainless steel sheet, and a small quantity of molybdenum trioxide was sprinkled on top of the pile. A block of the same magnesium alloy as that used in Example 1 was then placed on top of the pile and the sheet placed in a furnace containing an argon atmosphere and the temperature of the furnace was raised above 650° C. until the magnesium alloy melted. The furnace was allowed to cool whereupon the sheet was removed and examined. It was found that the molten magnesium alloy had completely infiltrated the silicon carbide grit to provide a composite material comprising silicon carbide particles dispersed in a magnesium alloy matrix.

EXAMPLE 11

Example 10 was repeated with the exception that the silicon carbide grit was replaced with milled Saffil filament (Saffil is alumina silicate filaments obtained from ICI). The magnesium alloy was found to have completely infiltrated the milled filaments to provide a composite material comprising Saffil filaments dispersed in a magnesium alloy matrix.

EXAMPLE 12

Example 1 was repeated with the exception that one of the tows of FP alumina was treated with an aqueous solution of ammonium molybdate instead of the suspension of molybdenum disulphide is iso-propyl alcohol. When the sheet was heated at above 450° C. in air, the majority of the ammonium molybdate was oxidised to molybdenum trioxide.

After the tows had been exposed to the molten magnesium alloy as described previously, they were cooled and examined. The tow which had been treated with the ammonium molybdate solution was found to have been completely infiltrated by the molten magnesium alloy whereas the untreated tow had not been infiltrated.

EXAMPLE 13

Six layers of a cloth measuring 5 cms×1.25 cms×0.6 cms woven from tows consisting of 14 μm diameter Nicalon silicon carbide filaments were treated with an aqueous solution of ammonium molybdate. The cloth was then heated at 450° C. in air to oxidise the ammonium molybdate to molybdenum trioxide.

The treated cloth was then stacked in a stainless steel mold having two open ends and a block of the magnesium based alloy described in example 1 placed adjacent one of the open ends in a furnace having an argon atmosphere. The furnace was then heated up to a temperature in excess of 650° C. in order to melt the alloy. It was found after cooling the furnace and removing the cloth therefrom that the cloth had been infiltrated by the molten magnesium alloy to provide a composite material consisting of woven tows of silicon carbide filaments enclosed in a matrix of the magnesium alloy.

EXAMPLE 14

The faces of two similar sized sheets of stainless steel were coated with an aqueous solution of ammonium molybdate and then heated above 450° C. in air in order to oxidise the ammonium molybdate to molybdenum trioxide. The sheets where then placed one on top of the other so that a small gap was defined between them. The adjacent sheets were then placed in a furnace having an inert atmosphere and containing a block of the magnesium alloy described in example 1. The sheets were so arranged that the edges thereof were adjacent the magnesium alloy block. The temperature of the furnace was then raised until the alloy melted. After allowing the furnace to cool down, the sheets were removed and examined. It was found that the molten magnesium alloy had been pumped by capillary action to occupy the space between the sheets. Thus the Example demonstrated that, for instance, thin walled castings of magnesium or alloys thereof could be easily produced by treating the internal walls of the casting in accordance with the method of the present invention.

EXAMPLE 15

Four sheets of a cloth woven from tows consisting 14 μm diameter Nicalon silicon carbide filaments and measuring 8 cms×5 cms were treated with an aqueous solution of ammonium molybdate. The cloth was then heated at 450° C. in air to oxidise the ammonium molybdate to molybdenum trioxide. Each sheet then had a magnesium based alloy block placed on top of it. The alloy had the following composition:

| | |
|---|---|
| Rare Earths | 4% by weight |
| Zinc | 3.5% by weight |
| Zirconium | 1.0% by weight |
| Manganese | 0.15% by weight |
| Copper | 0.03% by weight |
| Silicon | 0.01% by weight |
| Iron | 0.01% by weight |
| Nickel | 0.005% by weight |
| Balance Magnesium plus impurities. | |

The furnace atmosphere was changed to argon and temperature of the furnace raised to above 650° C. in order to melt the alloy. After cooling, the sheets were removed from the furnace and found to have been completely infiltrated by the magnesium based alloy.

The sheets were then stacked and placed on a stainless steel sheet and a further sheet of stainless steel placed on top of the stack. A 1.5 kilogram weight was then on top of the further sheet so as to maintain the stack under compression.

I claim:

1. A method of treating a surface so as to increase its wettability comprising the steps of:

coating said surface with an oxide selected from the group consisting of molybdenum trioxide, chromic oxide, ferric oxide and nickel oxide; and subsequently bringing said coated surface into intimate contact with molten magnesium or an alloy thereof under conditions inhibiting oxidation of said molten magnesium or alloy thereof.

2. A method of treating a surface as claimed in claim 1 including the step of utilizing filaments to provide said surface.

3. A method of treating a surface as claimed in claim 2 including infiltrating filaments with said molten magnesium or alloy thereof subsequent to oxide coating of said filaments.

4. A method of treating a surface as claimed in claim 2 including the step of utilizing tows for said filaments.

5. A method of treating a surface as claimed in claim 2 including the step of weaving said filaments into a form of a cloth.

6. A method of treating a surface as claimed in claim 2 including the step of forming said filaments from alumina.

7. A method of treating a surface as claimed in claim 2 including the step of forming filaments from silicon carbide.

8. A method of treating a surface as claimed in claim 1 including the step of applying said oxide coating to said surface in particulate form.

9. A method of treating a surface as claimed in claim 8 including the step of applying said oxide in particulate form to said surface dispersed in a liquid vehicle, and subsequently evaporated off.

10. A method of treating a surface as claimed in claim 8 including the step of applying said oxide in particulate form to said surface dispersed in a resin binder and subsequently burning off said resin binder prior to bringing said molten magnesium or alloy thereof into intimate contact with said surface.

11. A method of treating a surface as claimed in claim 1 including the step of producing said oxide coating by oxidation of a compound selected from the group consisting of the compounds of molybdenum, chromium, iron and nickel coated on said surface.

12. A method of treating a surface as claimed in claim 1 including the step of providing an inert atmosphere as the condition for inhibiting the oxidation of said magnesium or alloy.

13. A method of treating a surface as claimed in claim 1 including the step of immersing said surface in said molten magnesium or alloy to provide the intimate contact.

* * * * *